US009067312B2

(12) United States Patent
Koch et al.

(10) Patent No.: US 9,067,312 B2
(45) Date of Patent: Jun. 30, 2015

(54) TOOL HOLDER

(75) Inventors: Olaf Koch, Kaufering (DE); Alexander Buchenau, Puergen (DE); Stefan Hammerstingl, Munich (DE); Matthias Keith, Kaufbeuren (DE); Uto Plank, Freising (DE)

(73) Assignee: Hilti Aktiengesellschaft, Schaan (LI)

( * ) Notice: Subject to any disclaimer, the term of this patent is extended or adjusted under 35 U.S.C. 154(b) by 941 days.

(21) Appl. No.: 13/146,859

(22) PCT Filed: Jan. 21, 2010

(86) PCT No.: PCT/EP2010/050658
§ 371 (c)(1),
(2), (4) Date: Oct. 24, 2011

(87) PCT Pub. No.: WO2010/086270
PCT Pub. Date: Aug. 5, 2010

(65) Prior Publication Data

US 2012/0038119 A1 Feb. 16, 2012

(30) Foreign Application Priority Data

Jan. 30, 2009 (DE) ..... 10 2009 008 191

(51) Int. Cl.
*B25D 17/08* (2006.01)

(52) U.S. Cl.
CPC ..... *B25D 17/082* (2013.01); *Y10T 279/17051* (2015.01); *B25D 2250/211* (2013.01)

(58) Field of Classification Search
CPC ..... B25D 17/08; B25D 17/082; B25D 2250/211; Y10T 279/17051
USPC ..... 279/19.1, 19.2, 77, 89, 19, 33–35, 106; 173/162.1, 162.2
IPC ..... B25D 17/08
See application file for complete search history.

(56) References Cited

U.S. PATENT DOCUMENTS

| | | | | |
|---|---|---|---|---|
| 1,804,217 | A * | 5/1931 | Gustafson | 279/19.1 |
| 1,807,799 | A * | 6/1931 | Slater | 279/19.2 |
| 1,986,297 | A * | 1/1935 | Smith, Jr. | 279/19.1 |
| 2,042,926 | A * | 6/1936 | Curtis | 279/19.5 |
| 2,114,047 | A * | 4/1938 | Curtis | 279/19.1 |
| 2,122,516 | A * | 7/1938 | Curtis et al. | 279/19.1 |

(Continued)

FOREIGN PATENT DOCUMENTS

| | | |
|---|---|---|
| EP | 1 747 852 A2 | 1/2007 |
| EP | 1 872 913 A2 | 1/2008 |

OTHER PUBLICATIONS

PCT/EP2010/050658 PCT/IB/326, dated Aug. 11, 2011, 1 page.

(Continued)

*Primary Examiner* — Eric A Gates
(74) *Attorney, Agent, or Firm* — Crowell & Moring LLP

(57) ABSTRACT

The tool holder according to the invention for a chipping hammer has a tool receptacle for receiving a tool and a tool securing device for securing the tool in the tool receptacle. The tool securing device provides a shaft having an eccentrically arranged mandrel and at least one end piece and a bar having at least one eye in which the end piece engages in a form-fitting manner. The tool securing device is pivotable into at least one first position for inserting and removing the tool and into at least one second position for securing the tool. The eye has a non-circular cross-section.

9 Claims, 3 Drawing Sheets

(56) References Cited

U.S. PATENT DOCUMENTS

| | | | | | |
|---|---|---|---|---|---|
| 2,182,365 | A | * | 12/1939 | Smith | 279/19.1 |
| 2,230,046 | A | * | 1/1941 | Curtis | 279/19.1 |
| 2,400,206 | A | * | 5/1946 | O'Farrell | 279/19.5 |
| 2,489,923 | A | * | 11/1949 | Nast | 279/19.1 |
| 2,500,038 | A | * | 3/1950 | Lear | 279/19.1 |
| 2,604,328 | A | * | 7/1952 | Feucht | 279/19.1 |
| 2,720,401 | A | * | 10/1955 | Fuehrer | 279/19.1 |
| 2,752,889 | A | * | 7/1956 | Leavell | 173/91 |
| 2,817,316 | A | | 12/1957 | Ekstroem | |
| 2,935,327 | A | * | 5/1960 | Lear | 279/19.5 |
| 2,958,534 | A | * | 11/1960 | Fuehrer | 279/19.1 |
| 3,499,656 | A | | 3/1970 | Calmusky | |
| 3,910,590 | A | * | 10/1975 | Ekstrom | 279/19.1 |
| 4,440,237 | A | * | 4/1984 | Casperovich | 173/206 |
| 5,330,202 | A | | 7/1994 | Kimberlin et al. | |
| 5,431,235 | A | * | 7/1995 | Drumheller et al. | 173/211 |
| 5,450,911 | A | * | 9/1995 | Gustafsson | 173/13 |
| 7,726,413 | B2 | * | 6/2010 | Berghauser et al. | 173/171 |
| 2007/0024012 | A1 | * | 2/2007 | Hammerstingl et al. | 279/19.1 |
| 2008/0006423 | A1 | * | 1/2008 | Berghauser et al. | 173/132 |
| 2011/0108301 | A1 | * | 5/2011 | Erhardt et al. | 173/200 |

OTHER PUBLICATIONS

PCT/EP2010/050658 PCT/IB/338, dated Aug. 11, 2011, 1 page.
PCT/EP2010/050658 PCT/IB/373, dated Aug. 2, 2011, 1 page.
PCT/EP2010/050658 PCT/ISA/237, 5 pages.
German Search Report, dated Jul. 15, 2009, 3 pages.

* cited by examiner

TOOL HOLDER

FIELD OF THE INVENTION

The present invention relates to a tool holder for a chipping hammer.

DESCRIPTION OF THE PRIOR ART

Tool holders with a lock for chipping hammers are known from EP 1 872 913 A2, among other places. The tool holder may accommodate two of the conventional designs for tools and secure the tools by setting a bar. Provision is also made for the bar to be locked in a position in which the tool may be inserted in the tool holder or may be removed from it.

The bar is fastened on a rotatable shaft by means of pins. Strong forces act on the pins during the percussive operation of the chipping hammer. As a result, the pins are manufactured of highly resistant materials.

DISCLOSURE OF THE INVENTION

One object is making another tool holder available.

The tool holder according to the invention for a chipping hammer has a tool receptacle for receiving a tool and a tool securing device for securing the tool in the tool receptacle. The tool securing device has a shaft having an eccentrically arranged mandrel and at least one end piece and a bar having at least one eye, into which the end piece engages in a form-fitting manner. The eye has a non-circular cross-section. The tool securing device can be pivoted into at least one first position for inserting and removing the tool and into at least one second position for securing the tool.

The non-circular cross-section of the eye and of the end pieces, which preferably conform to one another, ensures that the bar and shaft cannot twist relative to each other.

The forces that occur during impact are introduced to the shaft essentially over the entire circumference of the eye. This may result in low levels of stress to the materials.

The end piece preferably has a larger cross-section than the shaft between the end pieces. The tool holder may have a bearing for mounting the shaft, with a cross-section of the bearing being the same as a cross-section of the end pieces. This facilitates a simple assembly. The shaft is inserted into the bearing and the bar is placed on the shaft. Additional fastening with pins may be omitted.

According to one embodiment, the bar has a contour line perpendicular to the shaft, the contour line having four rectilinear sections, and a flat stop face is provided; in each of the first and second positions, one of the four rectilinear sections rest on the flat stop face.

BRIEF DESCRIPTION OF THE FIGURES

The following description explains the invention on the basis of exemplary embodiments and figures.

Unless otherwise indicated, the same or functionally equivalent elements are identified by the same reference characters in the figures.

EMBODIMENTS OF THE INVENTION

Figure 1:
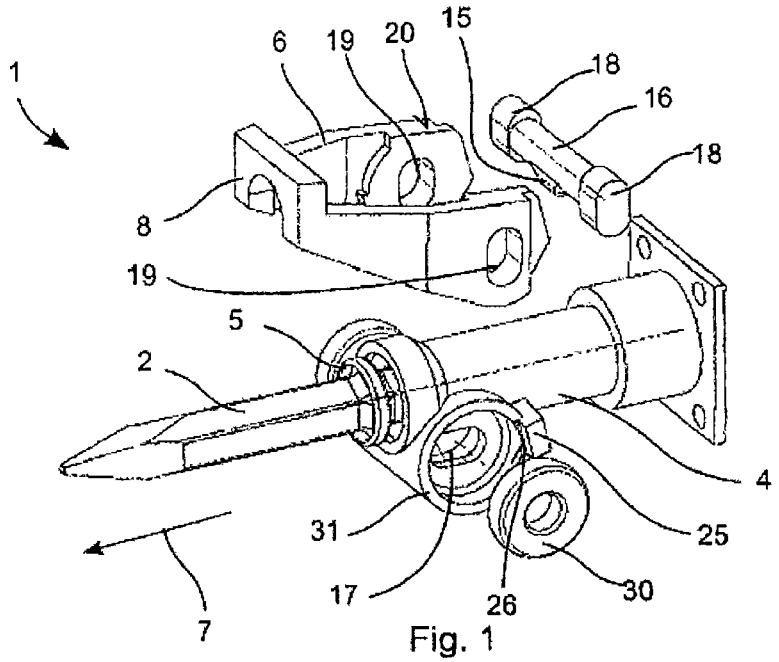
FIG. 1 illustrates an embodiment of a tool holder.

FIG. 1 shows an exploded view of an embodiment of a tool holder. The tool holder is constructed for holding tools 2, e.g., a chisel for a chipping hammer.

Figure 2:
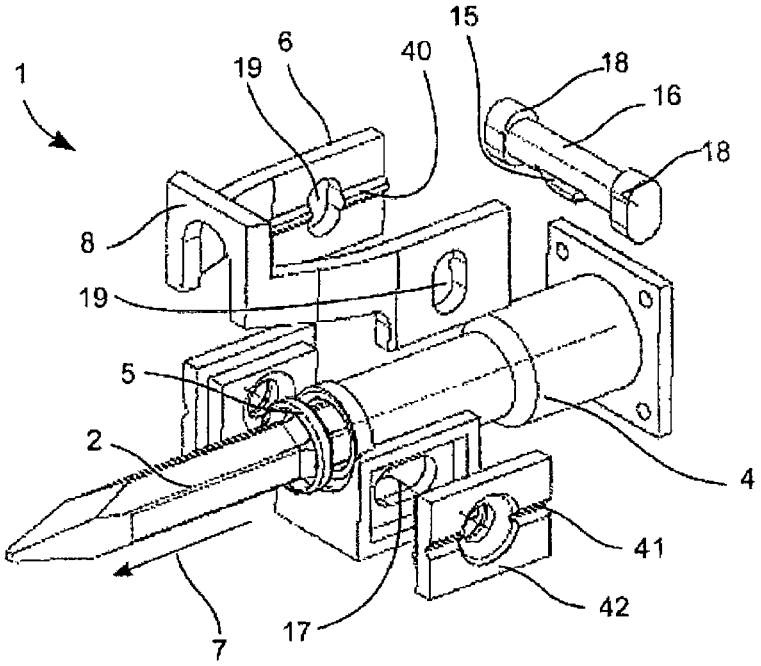
FIG. 2 illustrates another embodiment of a tool holder.

FIG. 2 shows an exploded view of another embodiment of a tool holder.

The longitudinal sections in FIGS. 3 to 6 depict a position for locking a tool of the first design in one of the tool holders and a position for inserting and removing the tool from the tool holder.

The longitudinal sections in FIGS. 7 to 10 show a position for locking a tool of the second design in one of the tool holders and a position for inserting and removing the tool from the tool holder.

The tool holders 1 are constructed for accommodating tools, in particular chisels. The known chisels 2 have two different designs with respect to how they are secured in a tool receptacle 4. The first design of the tool 2 is depicted schematically in FIGS. 1 to 6. The essentially cylindrical tool 2 has an annular collar 5. The tool holder 1 has a bar 6, which partially grips around the tool 2 behind the collar 5 in the impact direction 7 in such a way that the bar 6 forms a limit stop for the collar 5 in the impact direction 7. A front section 8 of the bar has instead a semi-circular contour, which can grip around the tool 2 next to the collar 5, but has a smaller diameter than the collar 5.

The second design of the tool 12 is depicted in the longitudinal sections in FIGS. 7 to 10. The tool 12 has a longitudinal groove 13 along a shaft of the tool 12, in which a mandrel 15 of the tool holder 1 may engage.

The bar 6 and the mandrel 15 are arranged pivotably around an axis in order to be able to remove/insert the tool 2, 12 from/into the tool holder 1 and lock it.

The mandrel 15 is arranged on a shaft 16. The shaft 16 is inserted into a bearing 17, in which the shaft 16 is freely rotatable. The shaft 16 has a circular cross-section within the bearing 17. On its two ends, the shaft 16 has two end pieces 18 having a non-circular cross-section. The cross-section of the end pieces 18 may have a greater surface area than the cross-section within the bearing 17.

The bar 6 is connected to the shaft 16 in a form-fitting manner. Two eyes 19 are positioned laterally in the bar 6 into which the end pieces 18 of the shaft 16 are inserted. The cross-section of the end pieces 18 corresponds to the cross-section of the two eyes 19. The non-circular cross-sections ensure that the bar 6 cannot be twisted relative to the shaft 16 without requiring fastening or securing pins. Thus, pivoting the bar 6 causes the shaft 16 to rotate.

The bar 6 has a contour line 20 having four sections 21, 22, 23, 24. The contour line 20 runs perpendicular to the shaft 16, with the center of each of the sections 21, 22, 23, 24 being at approximately the same distance from the shaft 16. Arranged on the bearing 17 is a block 25, which has a flat surface 26. The contour line 20 and the block 25 are constructed in such a way that four positions of the bar 6 result in which the bar 6 engages on the block 25. The four engagement positions will be depicted on the basis of FIGS. 3 to 10.

Figure 3:
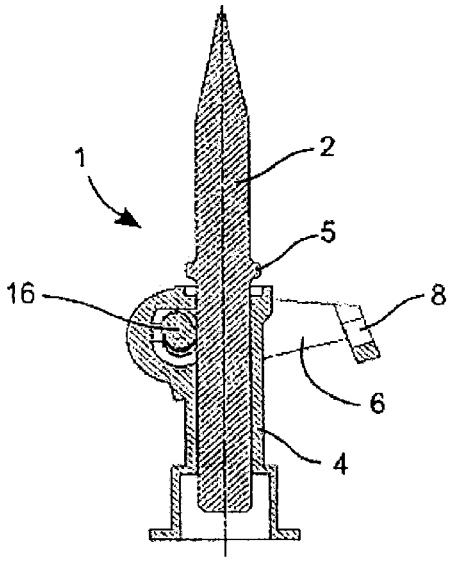
FIGS. 3 to 10 are longitudinal sections through the tool holder in FIG. 1 or FIG. 2.
Figure 4:
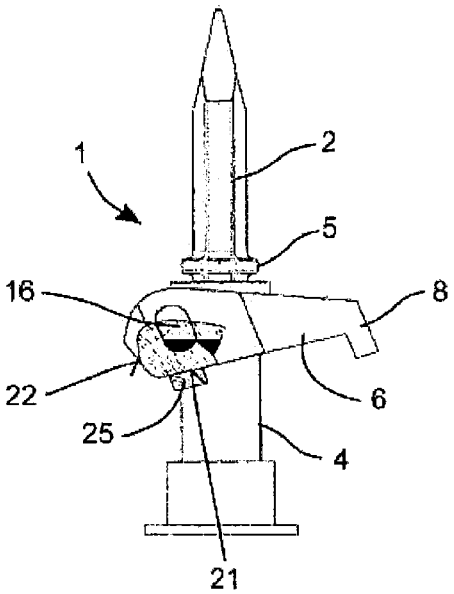

FIGS. 3 and 4 show a first engagement position for releasing the first tool 2. The contour line 20 has a rectilinear section 21, which is adjacent to the flat surface 26 of the block 25. A pure rotation around the shaft 16 is prevented by the rectilinear arrangement.

Figure 5:
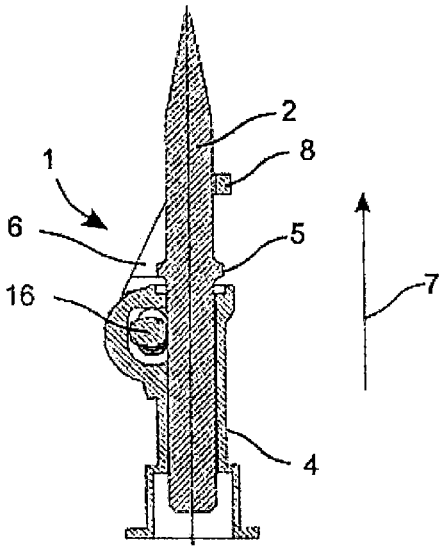
Figure 6:
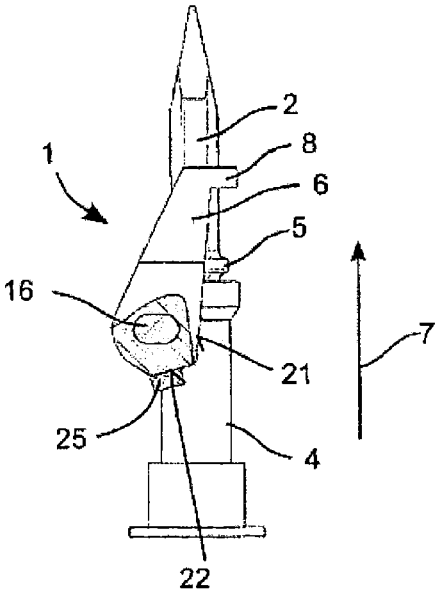

FIGS. 5 and 6 show a second engagement position for securing the first tool 2. A path of the tool 2 in impact direction is limited by the collar 5 through the front surface 8 of the bar 6. The contour line 20 has a second rectilinear section 22, which is adjacent to the flat surface 26 of the block 25. A pure rotation around the shaft 16 is prevented by the rectilinear arrangement.

Figure 7:
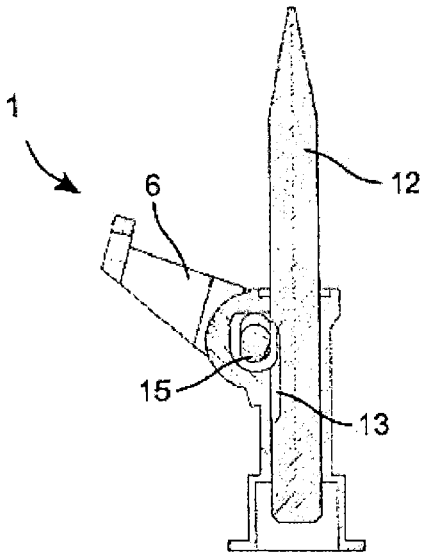
Figure 8:
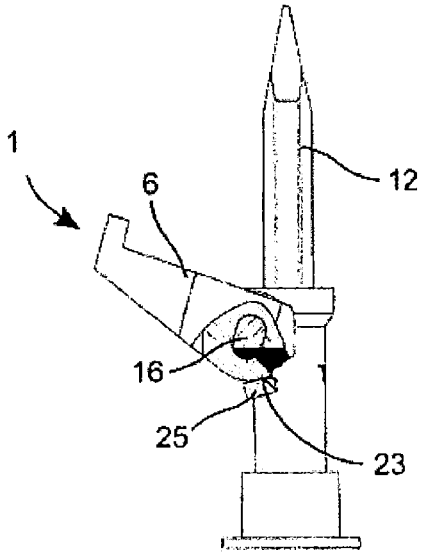

FIGS. 7 and 8 show a third engagement position for releasing the second tool 12 with a longitudinal groove 13. The eccentrically arranged mandrel 15 does not engage in the longitudinal groove 13. The contour line of the bar 6 is adjacent to the block 25 engaged with the third section 23.

Figure 9:
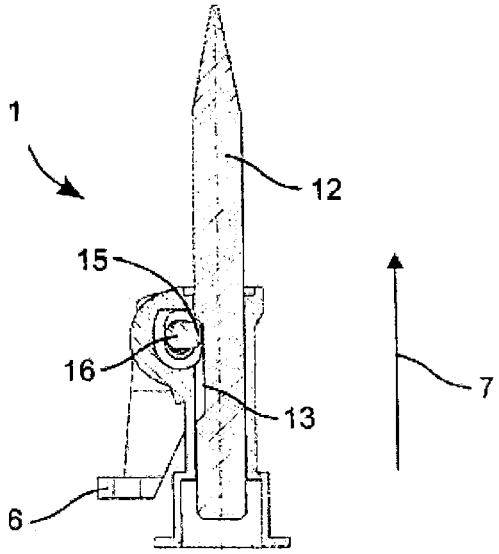
Figure 10:
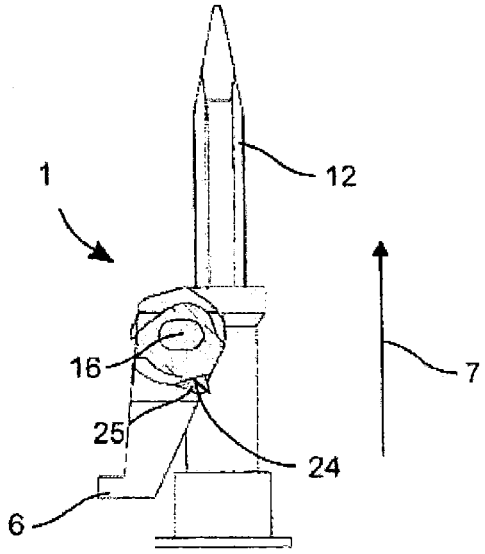

FIGS. 9 and 10 show a fourth engagement position for securing the second tool 12. The eccentrically arranged mandrel 15 engages in the longitudinal groove 13 and limits the motion of the tool 12 in the impact direction 7. The fourth section 24 is rectilinear and abuts the flat block 25, whereby the bar 6 engages.

Pivoting the bar 6 out of an engaged position is accomplished by an elastic mounting of the shaft 16 in the bearing 17. The bearing 17 is designed to be oblong in a direction perpendicular to the axis of shaft 16 in such a way that the shaft 16 is displaceable in this direction. A ring 30 made of an elastic material holds the shaft 16 in a central position of the bearing 17. The ring 30 may support itself on the tool holder 1 or on the bearing 17 in a circular receptacle 31.

When the bar 6 is pivoted, the elastic ring 30 is squeezed until a subsequent engagement position is reached by a planar contact of one of the rectilinear sections 21, 22, 23, 24 on the flat surface 26.

FIG. 2 depicts an embodiment in which, instead of or in additional to the contour line 20, projections 40 or crosspieces are provided on the bar 6, which can engage in corresponding depressions 41 or pockets on the tool receptacle 1. The profile of the projections and depressions is aligned along the shaft 16. The depressions or associated projections may be arranged at different angles around the shaft 16 such that the bar correspondingly has four engagement positions. The depressions 41 may be placed in an elastic element 42, which is supported perpendicularly against the tool receptacle 4.

The invention claimed is:

1. A tool holder for a chipping hammer, comprising:

a tool receptacle for receiving a tool; and a tool securing device for securing a tool in the tool receptacle;

wherein the tool securing device includes a shaft having an eccentrically arranged mandrel, an end piece, and a U-shaped bar having an eye in which the end piece is engageable in a form-fitting manner;

wherein the tool securing device is pivotable into a first position for inserting and removing a tool and into a second position for securing a tool;

and wherein the eye has a non-circular cross-section.

2. The tool holder according to claim 1, wherein the end piece has a larger cross-section than at least a portion of the shaft.

3. The tool holder according to claim 1, wherein the shaft has a circular cross-section in at least a portion of the shaft.

4. The tool holder according to claim 1, further comprising a bearing, wherein the shaft is mounted in the bearing and wherein a cross-section of the bearing is a same value as a cross-section of the end piece.

5. The tool holder according to claim 4, wherein the shaft is displaceable in the bearing out of a central position in a direction perpendicular to an axis of the shaft, and further comprising an elastic restoring element disposed on the shaft.

6. The tool holder according to claim 5, wherein the elastic restoring element has an elastic ring which encircles the shaft and is supported on the bearing.

7. A tool holder for a chipping hammer, comprising:

a tool receptacle for receiving a tool;

a tool securing device for securing a tool in the tool receptacle;

wherein the tool securing device includes a shaft having an eccentrically arranged mandrel, an end piece, and a bar having an eye in which the end piece is engageable in a form-fitting manner;

wherein the tool securing device is pivotable into a first position for inserting and removing a tool and into a second position for securing a tool;

wherein the eye has a non-circular cross-section; and a bearing, wherein the shaft is mounted in the bearing and wherein a cross-section of the bearing is a same value as a cross-section of the end piece;

and wherein the bar has four rectilinear sections, wherein the bearing has a block with a flat stop face, and wherein each of the four rectilinear sections are engageable with the flat stop face.

8. The tool holder according to claim 1, wherein the end piece has a non-circular cross-section that corresponds to the non-circular cross-section of the eye of the U-shaped bar.

9. The tool holder according to claim 8, wherein the end piece has a non-circular cross-section that corresponds to the non-circular cross-section of the eye of the bar.

* * * * *